United States Patent [19]

Kirby et al.

[11] 4,361,105

[45] Nov. 30, 1982

[54] BARGE-CARRYING VESSEL

[75] Inventors: William E. Kirby, Hong Kong, Hong Kong; David J. Seymour, Daly City, Calif.

[73] Assignee: Wharton Shipping Corporation, Edificio Vallarino, Panama; by said D. J. Seymour, a part interest

[21] Appl. No.: 214,412

[22] Filed: Dec. 8, 1980

[51] Int. Cl.[3] ..... B63B 35/40

[52] U.S. Cl. ..... 114/260; 405/1; 414/138

[58] Field of Search ..... 114/260, 258, 259, 72; 405/4, 1, 3; 414/137, 138, 140

[56] References Cited

U.S. PATENT DOCUMENTS

| | | | |
|---|---|---|---|
| 3,508,510 | 4/1970 | Frankel | 114/260 |
| 3,709,181 | 1/1973 | Papanicolaou et al. | 114/72 |
| 3,863,585 | 2/1975 | Vernede et al. | 114/260 |
| 3,939,790 | 2/1976 | Varges et al. | 114/260 |
| 4,147,123 | 4/1979 | Kirby et al. | 114/260 |

FOREIGN PATENT DOCUMENTS

| | | | |
|---|---|---|---|
| 821881 | 10/1959 | United Kingdom | 114/72 |
| 878247 | 9/1961 | United Kingdom | 114/72 |
| 592697 | 3/1978 | U.S.S.R. | 114/259 |

*Primary Examiner*—Trygve M. Blix
*Assistant Examiner*—C. T. Bartz
*Attorney, Agent, or Firm*—Owen, Wickersham & Erickson

[57] ABSTRACT

An improvement in a barge-carrying flotation-loaded waterborne vessel. A hollow interior defines upper and lower longitudinal barge holds arranged in vertical rows of aligned tiers, each hold being flooded during the time it is loaded and unloaded. There is at least one loading lock at one end of the vessel for enabling flotation loading of each vertical row of barge holds; each lock has a pair of side bulkheads and a bottom, and gate means for separating the lock from and opening it to the outside for flotation loading and unloading of one barge at a time. There is also a separate lock gate for each tier of each row for connecting a hold of each row to a lock. In each lock there are sets of barge support panels, each pivotally attached by a horizontal longitudinally extending pivot to one of the side bulkheads, at least one set being disposed on each side of the lock adjacent to and approximately on a level with each upper longitudinal barge hold. Associated with each set of barge support panels is an erection system for swinging panels up from a vertical storage position to a horizontal barge-supporting position. First locking and releasing means secure each panel in its vertical storage position and release each panel for movement to its load-supporting position. Second locking and releasing means secure each panel in its horizontal barge-supporting position and release each panel to return to its vertical storage position.

28 Claims, 18 Drawing Figures

FIG. 7-A 150
151
152
153
154
155
156
157
160
161
162
163
164
165
166
167
168
60
14
17

BARGE-CARRYING VESSEL

BACKGROUND OF THE INVENTION

This invention relates to a barge-carrying waterborne vessel with at least two tiers of barge holds and a lock for flotation loading of barges into those holds. More particularly, the invention relates to a means for employing the otherwise unoccupied space of the lock for stowing a plurality of barges during a voyage. The invention also relates to a bow-loaded multi-tiered vessel using locks for flotation loading.

Many problems, often related to the high cost of labor, have recently changed the economic and technical natures of shipping. For example, for many centuries materials have been transported by barges on rivers, lakes, canals, and inland waterway systems to ports near the river mouth, unloaded there from the barges, loaded onto ocean-going vessels, sent to other ports across the sea, unloaded there, and reloaded in many instances onto other barges to be shipped up another river system. In recent years, however, the costs of loading and unloading cargo have risen higher at an ever-increasing rate. Containerizing of cargoes has helped somewhat, but even then, as well as in bulk-loaded barges, there has remained the necessity of unloading the barges at one port, placing the container and other cargo on a pier, and then loading from the pier into an ocean-going vessel, only to require the reverse procedure in the ports to which the cargo is carried by that vessel. All this adds considerably to the ultimate cost of the product concerned, and the time required for transportation.

An apparent answer to the problem is to ship the barges themselves. Since they cannot undergo an ocean voyage directly in the water, this would require loading the barges aboard an ocean-going vessel. However, few vessels are capable of carrying a series of barges aboard, and the problem of loading barges on the vessels must be confronted. The barges are often very large and heavy; cranes or elevators to lift them would be very expensive. In fact, large river barges cannot be lifted by cranes or elevators.

Recent inventions such as our U.S. Pat. No. 3,913,512, issued Oct. 21, 1975, and our co-pending application, Ser. No. 105,414, now abandoned, filed Dec. 19, 1979 have proposed flotation loading of barges and other cargo-carrying containers into barge-carrying ships. Since the barges are already in the water, flotation loading can be employed with a specially constructed ship that has a suitable hold and a gate through which the barge may be floated into the hold.

However, barges are not as easily handled as are smaller cargo-carrying containers; so particular provisions have had to be made for them. Many barge types are long relative to their beam. The barges used on the Mississippi and Rhine rivers, for example, are very long compared to their width; the Mississippi barges are more than 60 meters long and more than 10 meters wide. For a barge-carrying system to be practical, the ocean-going, barge-transporting vessel must be able to carry many barges. A ship able to accommodate only a single line of barges would, of necessity be extraordinarily long and narrow to be profitable. This general problem was solved in our U.S. Pat. Nos. 3,978,806, issued Sept. 7, 1976; and 4,135,468, issued Jan. 23, 1979. Those patents relate to a vessel having a plurality of longitudinal holds, side by side, either two or three parallel holds, each of which can take the full width of a barge and each of which can accommodate several barges in line or tandem. Also, the problem of loading and unloading the vessel with barges was alleviated by mechanisms shown, for example, in our U.S. Pat. No. 4,147,123, which issued Apr. 3, 1979.

A problem that arises as soon as one attempts to load two or more tiers of barges in a single vessel, is the problem of draft. A few ports can accommodate drafts up to 75 or 80 feet, drafts that exceed those of most vessels, so that their depths would accommodate a ship loading two or more tiers of barges. However, most ports have depths less than 40 feet. A system restricted to voyages between deep-draft ports would not be econimically practical. For this reason, the preferred form of these barge-carrying vessels has a lock disposed at one end, for hydraulically elevating barges to the various tier levels in floatation loading. This broadens the range of barges on which the system can operate; not requiring any special roller mechanisms for dry loading and unloading. It also increases the number of ports which may be serviced.

The economic feasibility of this mode of transportation depends on being able to load and carry the maximum amount of cargo in a minimum of space. Each unused or unusable area in the vessel detracts from its profitability. It is, therefore, desirable to maximize a vessel's efficiency by using as much potential cargo-carrying space as possible.

To that end, a problem has arisen. The space occupied by the loading lock has been generally unusable for the transportation of cargo. At best, it had been possible to store and transport one barge on the bottom of a lock. Since the lock typically extends from the lowest tier to the upper deck of such vessels, space which could otherwise be used to store at least one extra barge for each tier of longitudinal barge holds serviced by the lock has remained unused. This was primarily because of an inability to securely support barges at multiple levels of a loading lock without interfering with the operation of the lock when loading.

One recently proposed system as illustrated in our co-pending application Ser. No. 105,414, now abandoned employs horizontal barge support members which can be projected our from and retracted into the side bulkheads of a loading lock. This solution, however, gives rise to other problems of inefficient space use because storage space on the sides of the lock's bulkheads is required to receive these sliding supports when they are not in use. This reduces the otherwise usable storage space and severely limits the number of adjacent, independently operating locks which may be disposed together at the end of a vessel.

Heretofore, no one has proposed a feasible system of this kind. For example, the vessel shown in the Vargas U.S. Pat. No. 3,939,790, which issued Feb. 24, 1976, involves flotation loading and unloading and accommodates up to three tiers of relatively small lighters, especially designed to be lifted or hung by their ends, but the vessel cannot support full size river barges. Vargas shows a hold having supporting brackets which are movable out of the side walls of the dock chamber. The Vargas supports are stored flush against the side walls or bulkheads in a recess, and swing out along a vertical axis to provide points of support to the side edges of barges. The supports are received by sockets in the lash type barges which the system is designed for, and requires careful placement of the barge. These supports, however, are designed for loads which are far lighter than the barges transported in the vessel of the present invention. Furthermore, since only *points* of support are provided, and not an *extended surface* on which to support the barges, a great deal of instability is inherent in the use of the system.

Thus, an important object of the invention is to provide a means and a method for supporting a barge at each level within a loading lock.

Another object is to provide barge support means entirely disposed at all times within the lock, and yet not interfering with the loading operation.

Another object of the invention is to provide a broad support surface for supporting a barge at various upper levels in the lock of a barge-carrying vessel, the apparatus providing the support surface being readily stored in the side bulkheads of the lock, yet easily and automatically erected, and not interfering with lock operation.

Yet another object of the present invention is to provide an efficient and simple system for maximizing the usuable barge transporting area of a flotation-loading waterborne vessel to include the upper areas of the loading locks.

SUMMARY OF THE INVENTION

The invention comprises a series of load-supporting panels on each side of each deck level of each loading lock for a flotation-loaded and flotation-unloaded barge carrier. Each panel has a plurality of spaced-apart, parallel support arms comprised of a buoyant section and an attachment section, the buoyant sections have a plurality of grate or platform sections disposed between adjacent support arms. The sets of panels of the invention, preferably four panels per barge, two on each side of the lock, are swingingly attached along a horizontal pivoting axis to corrugated side bulkheads in the lock chamber.

The invention provides means for automatically erecting and stowing the sets of barge-supporting panels. Such means include buoyancy tanks, which are part of the support arms of the panels, having flood valves associated with barge-actuated valve controls for flooding and emptying the buoyancy tanks. Locking mechanisms, for securely holding the panels in the erect, barge-supporting position are also provided. These locking or securing means include either a lock pin arrangement or a lock stop arrangement.

The method of the invention involves, first, loading the main barge holds of the vessel and then floating a barge in the lock to the level of the uppermost deck, and erecting and securing in place support panels in the lock under the barge. In the next step, the water level in the lock is lowered, and the barge settles on the panels, and is secured there. If there is a plurality of main holds, the invention calls for accommodating a barge at each deck level in the same manner. Finally, a barge may also be stowed on the lock bottom level.

Unloading is accomplished by first releasing any barge stowed on the lock bottom. Then the next, lowermost, lock-stowed barge is released from being secured for transportation. The lock water level is raised to float the barge, and then the support panels beneath it are stowed. The lock water level is lowered to the vessel's waterline, the barge is floated out, and the process repeated for other barges stored thereabove in the lock. Then the holds are unloaded.

BRIEF DESCRIPTION OF THE DRAWINGS

In the drawings:

FIG. 7A is an enlarged view in section of a support arm in vertical position.

DETAILED DESCRIPTION OF THE PREFERRED EMBODIMENTS

The vessel 30

(FIG. 1)

Figure 1:
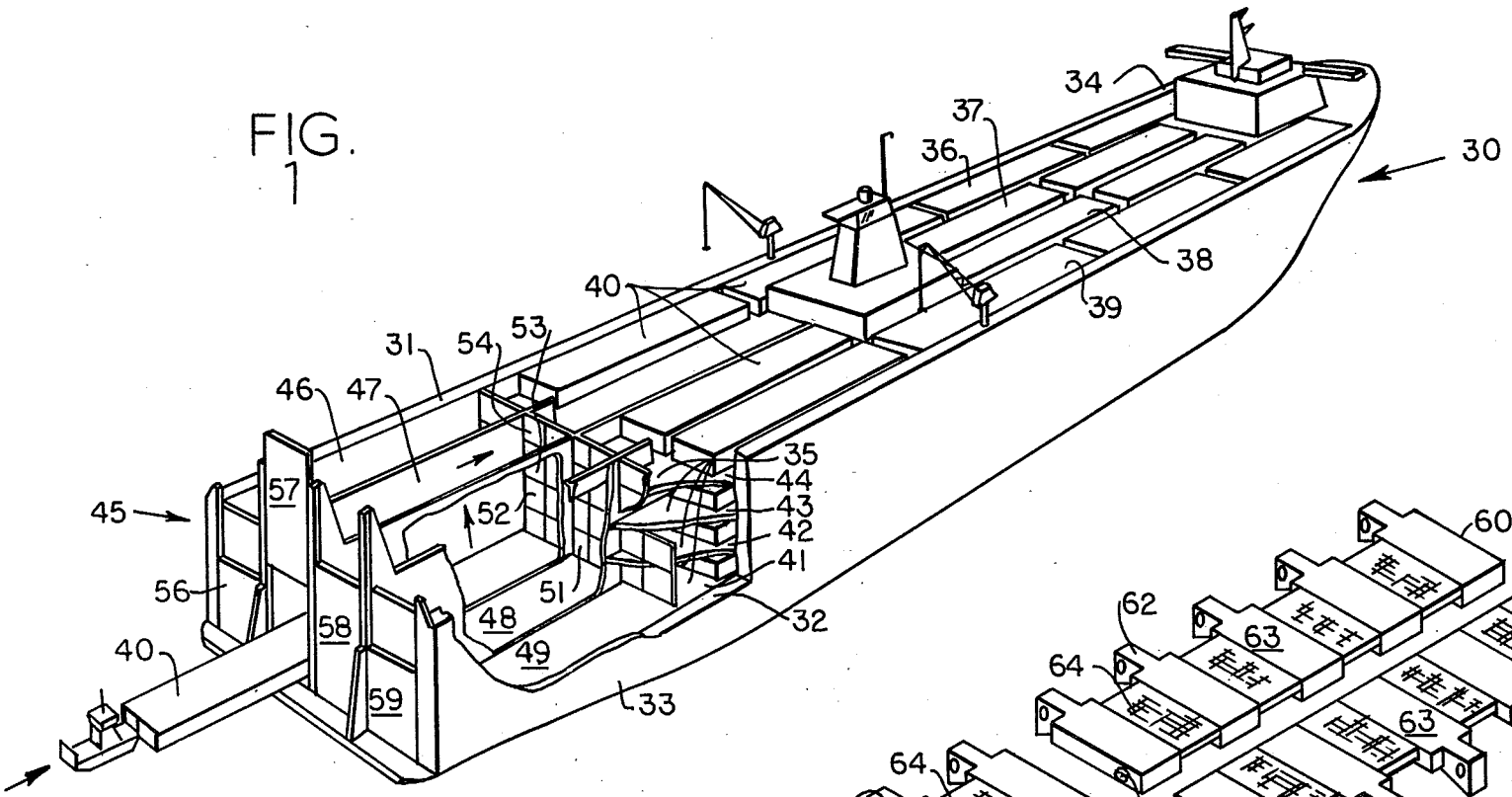
FIG. 1 is a rear perspective view of a barge-carrying vessel of the invention, partially cut away to illustrate the arrangement of the longitudinal barge holds and the lock chamber.

As illustrated in FIG. 1, the invention pertains to a barge-carrying vessel 30, designed for flotation loading and unloading. The vessel 30 has a series of compartmented port, starboard, and bottom buoyancy tanks 31, 32, and 33 for raising and lowering the vessel with regard to the vessel's waterline. There are also lock trim buoyancy tanks 34 at the bow end of the vessel 30, all generally as in our co-pending application Ser. No. 105,414, filed Dec. 19, 1979, now abandoned. The vessel 30 has a plurality of longitudinal barge holds 35 at several deck levels, in each of which barges may be carried. In the embodiment illustrated in FIG. 1 there are four vertical rows of barge holds: port outboard holds 36, port inboard holds 37, starboard inboard holds 38, and starboard outboard holds 39. Barges 40 are shown being carried on four deck levels: a first bottommost tier 41 above the bottom buoyancy tank 33, a second tier 42 thereabove, a third tier 43 above that, and a topmost fourth tier 44 or upper deck, which may be open to the sky. The barges 40 are orientated longitudinally in the holds 35, parallel with the direction of the vessel 30. Here, there are sixteen holds 35, four parallel rows of longitudinal barge holds at each of four deck levels. There may be fewer levels or rows in both.

A number of barge locks are disposed at the stern 45 of the vessel 30 to enable flotation loading and unloading. There is preferably one barge lock for each longitudinal row of barge holds 35. As shown in FIG. 1 there is a port outboard barge lock 46, a port inboard barge lock 47, a starboard inboard barge lock 48, and a starboard outboard barge lock 49. Each barge lock has a water-tight inner barge lock gate for each of the barge hold levels. In the embodiment illustrated at FIG. 1 each of the barge locks has a first tier inner gate 51, a second tier inner gate 52, a third tier inner gate 53, and a fourth tier inner gate 54. Each of the barge locks 46, 47, 48, 49 further has a respective water-tight stern gage 56, 57, 58, 59, each with mechanical, pneumatic, or hydraulic elevating means for raising and lowering its stern gate.

Barges 40 are loaded onto the vessel 30 by first opening one or more of the barge lock stern gates 56, 57, 58 or 59. Minimum vessel draft when loading and good trim may be obtained by loading simultaneously with two locks on opposite sides of the vessel's centerline and by operating them so that two locks are filled while two are empty of water. The vessel's compartmented buoyancy tanks 31, 32, and 33 are used to adjust the bottom level of the barge locks 46, 47, 48, 49 to lie beneath the waterline, by at least the draft of a loaded barge 40. The barge is floated into one of the locks 46, 47, 48, 49 without interference from the vessel 30. Only one tier at a time is flooded with water and loaded (typically beginning with the top tier 44 and working down), and it is flooded to a level greater than the draft of a typical barge 40, or approximately three meters. The barge lock stern gate 56, 57, 58, or 59 is closed, and the barge lock 46, 47, 48, 49 is filled with water, which may be pumped in by a barge lock pump (not shown) to a water level appropriate for the tier 41, 42, 43 or 44 being loaded. The barge 40 rises in the lock 46, 47, 48 or 49 as the water level rises. When the water level is to the deck level desired, the matching inner barge lock gate 51, 52, 53, or 54 is opened, and the barge 40 is floated forward into a hold 35 and floated forward to the position in which it is to be stowed during the voyage. Once the barge 40 is fully inside its hold, the inner barge lock gate 51, 52, 53, or 54 is closed, and the water level in the lock 46, 47, 48 or 49 is lowered back down to the waterline. Then the barge lock stern gate 56, 57, 58, or 59 is opened, and another barge 40 is loaded into that lock.

Once the uppermost tier 44 has been loaded to capacity with barges 40, the next lower tier 43 is loaded, then the next lowest tier 42 is loaded, and finally the lowest tier 41 is loaded. Once the tiers have been loaded, the lock is not longer needed as a lock until the barges 40 are unloaded. It is desirable to stow another barge 40 for each tier in each lock during the voyage, to make complete use of all available cargo space and to increase the vessel's efficiency.

The barge support panels 60

Figure 2:
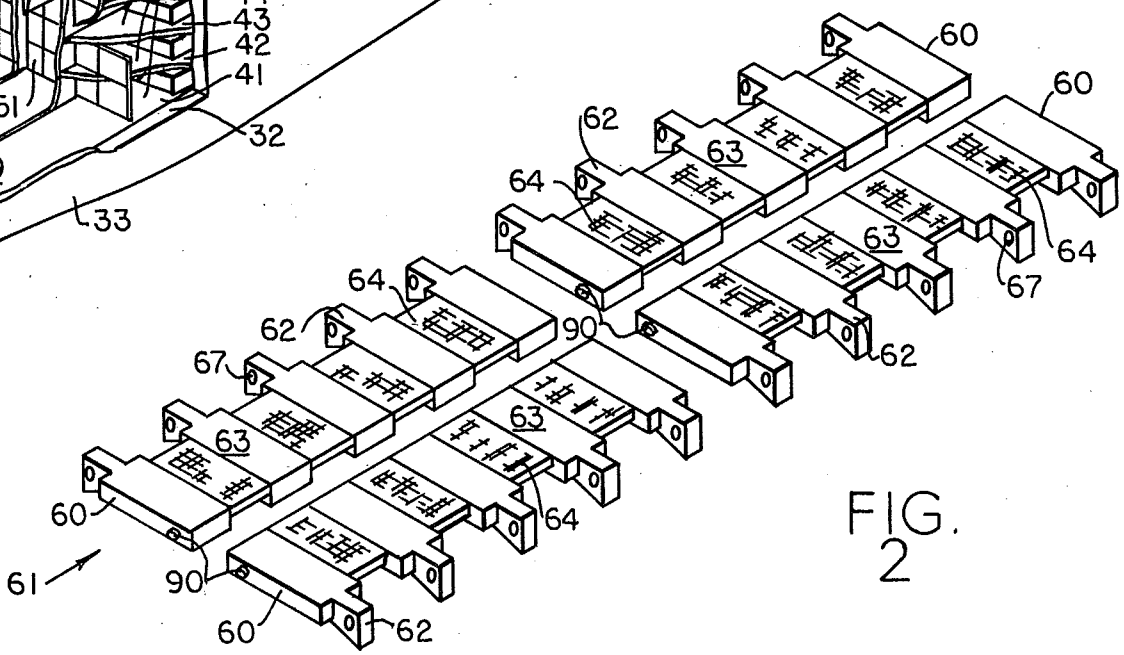
FIG. 2 is a top perspective view on a large scale of a set of four panels embodying the invention, these four panels being used to support one barge in a lock.
Figures 3, 4, 5, 6, 7:
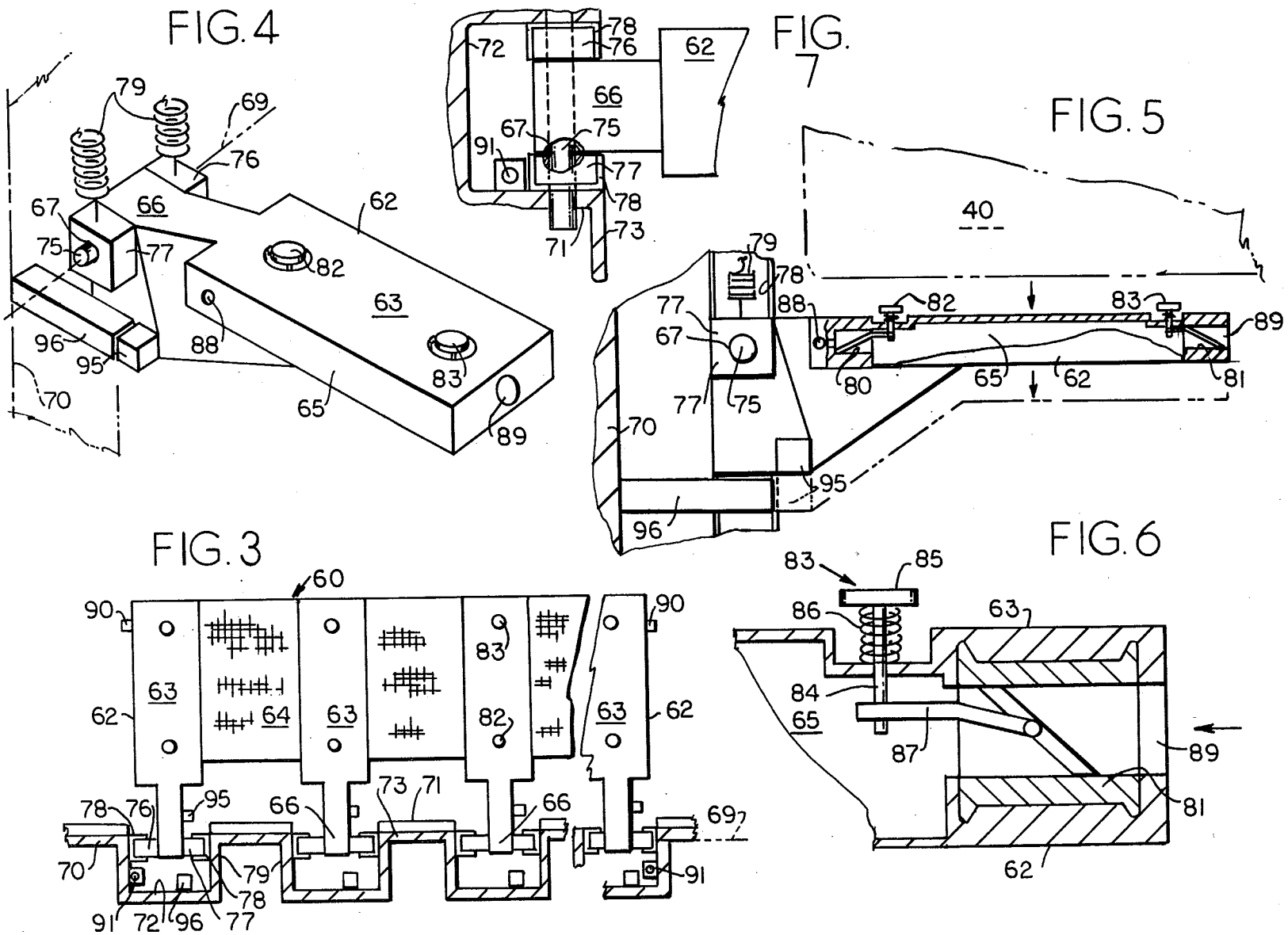
FIG. 3 is a top plan view on an enlarged scale of a portion of panel of the invention attached to a corrugated bulkhead, the bulkhead being broken away to illustrate the attachment means, the view also being broken to conserve space.
FIG. 4 is a further enlarged top perspective view of one support arm of the invention, showing some associated parts.
FIG. 5 is an enlarged end view, in section, of the support arm of FIG. 5, illustrating in particular the flood valve and actuator mechanism.
FIG. 6 is a still further enlarged elevational view in section of a flood valve and valve actuator of the invention.
FIG. 7 is a fragmentary top plan view of one end of the support arm, with portions broken away and shown in section.
Figure 17:
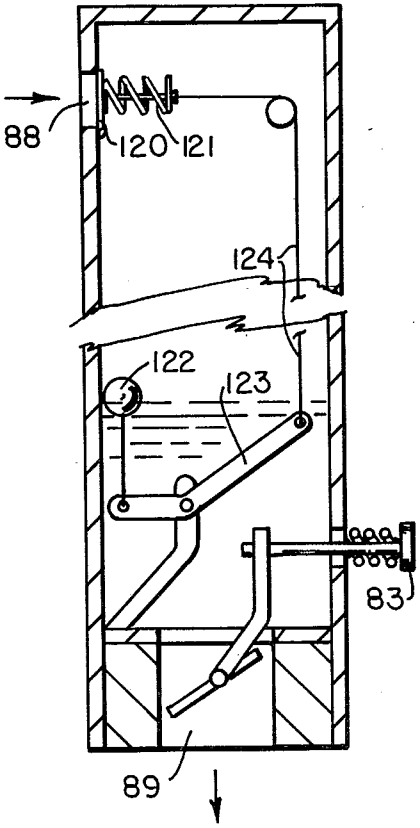
FIG. 17 is a view in section taken along the line 17—17 in FIG. 14.
Figure 17:
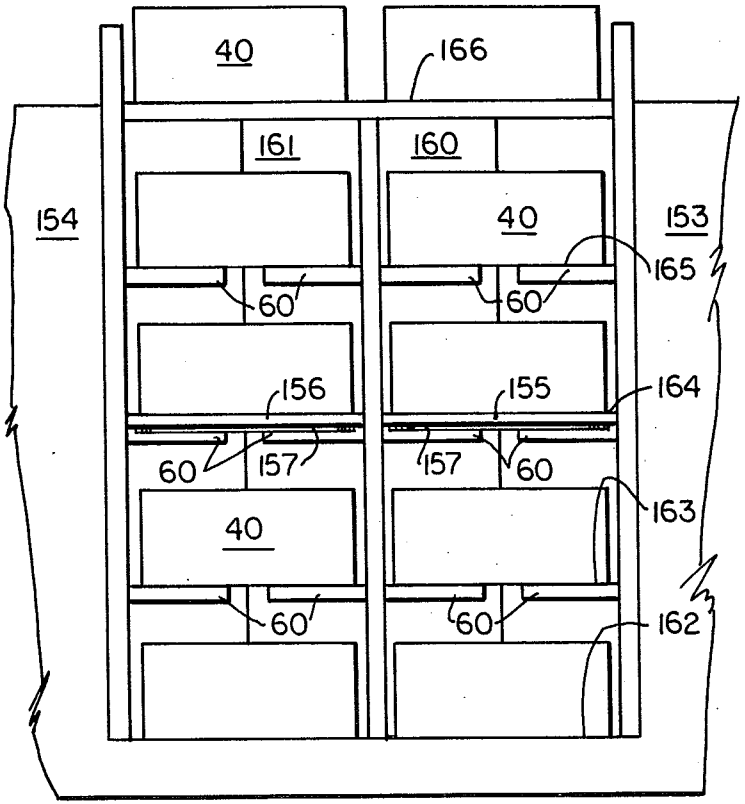

(FIGS. 2 and 3)

Barge storage within the locks 46, 47, 48, or 49 is facilitated by a plurality of barge support panels 60; a set 61 of four panels 60, as illustrated in FIG. 2, is preferably used to support each large barge 40. There may be a set 61 at each upper tier 42, 43, and 44, but not at the bottom-most tier 41, where the barge 40 can rest on the bottom of the lock. For example, in the vessel 30 shown in FIG. 1, each barge lock 46, 47, 48, and 49 would have three sets 61 of barge support panels 60, one set 61 adjacent to the second tier 42, one set 61 adjacent to the third tier 43, and a set 61 adjacent to the uppermost tier 44 (see FIG. 9).

Each panel 60 has a series of support arms 62 spaced apart from each other and having a top surface 63 and joined to each other by a series of metal gratings 64 flush with the top surface 63. The gratings 64 may be welded to the arms 62. The weight of a barge 40 on a set 61 is thus (in this example) borne by four panels 60 and, in each panel, directly or indirectly by the support arms 62 of each panel 60. The gratings 64 let water pass through freely in order to lessen the load during erection of the panels 60. In a preferred embodiment there may be eight support arms 62, each designed to support a load of fifty-two metric tons, and each panel 60 may be designed to support four hundred sixteen metric tons, since a loaded Mississippi river barge 40 typically weighs one thousand six hundred fifty metric tons.

The support-arm 62

(FIGS. 3–5 and 7)

Each support arm 62 (see FIGS. 4 and 5) is preferably an integral member comprising a buoyancy tank 65 as a major portion thereof and a pivoted end member 66 with a horizontal pivot opening 67 therethrough, about which the arm 62 swings from its vertical storage position to its horizontal support position.

Each panel 60 is pivotally attached to the structure of the ship along a horizontal axis 69 (see FIG. 3). The side walls of the lock are preferably corrugated bulkheads 70 having a series of projections 71 and recesses 72. Those corrugated bulkhead projections 71 which are disposed adjacent to a panel 60 are preferably truncated and provided with connecting webs 73 set back from the normal extremity of the projections 71 by a distance equal to the thickness of the grating 64. This enables the grating 64 to lie flush against the side bulkheads 70 when the panels 60 are in their storage position. For those lock walls which separate one lock from another, the corrugations mean that the panels in one lock are slightly out of line with those of the next lock, since the projections for one lock are the recesses of the other one.

FIGS. 3, 4, and 7 illustrate one means of attachment of the support arms 62 relative to the bulkhead 70. In this form of the invention, a pivot pin 75 extends through and beyond the pivot opening 67 and a pair of pin travel blocks 76 and 77 and are secured to the ends of the pin 75, one on each side of the end member 66.

Each travel block 76 and 77 is arranged to travel up and down in a guideway 78, and a spring 79 urges each block 76, 77 upwardly, as by exerting pull on it. Thus, the support arms 62 can swing between a vertical storage position (FIG. 8) and a horizontal load-supporting position (FIG. 5) by pivoting around their pins 75, the pins 75 themselves being attached rigidly to the travel blocks 76 and 77. The weight of the arm 62 tends to pull the travel blocks 76 and 77 down, and the weight of the arm 62 is considerably greater when the buoyancy tanks 65 are filled with water than when they are filled with air.

The buoyancy tank portions 65

(FIGS. 4 to 6)

The buoyancy tank portion 65 of the support arm 62 preferably has a pair of check-type flood valves 80 and 81 and a pair of valve actuators 82 and 83. the valve actuators 82 and 83 extend upwardly and above the top surface 63 of the support arm 62, and each of them has a rod or spring stem 84 with a contact head 85 at its top. A spring 86 holds the contact head 85 in a normally closed or "up" position. The rod 84 is connected by a linkage 87 to the flood valve 80 or 81, which remains closed when the contact head 85 is up and which opens when the contact head 85 is pressed down. Each valve 80 has its respective vent port 88, so that air can enter the buoyancy tank 65 at the time when a valve 89 is allowing water to exit from the buoyancy tank 65 when the support arm is in a vertical position, as shown in FIG. 7A. The vent port 88 is opened and closed by a valve 120, normally urged to a closed position by a spring 121 and opened by a ball float 122, attached to a crank 123 and therethrough to a wire 124 that passes via a pulley wheel 125 to the valve 120, when and only when the buoyancy tank 65 is flooded does the ball float 122 open the valve 120 and then it holds it open until the buoyancy tank 65 is substantially emptied in its vertical stowed position.

The Locking Means for the Panels 60

(FIGS. 3–5, 7 and 8)

There are two sets of locking means: one for locking the panels 60 in their vertical storage position and the other for locking them in their horizontal load-supporting position.

Figure 8:
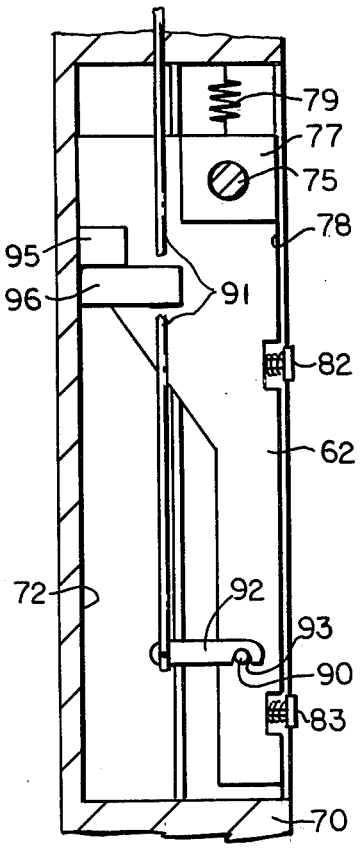
FIG. 8 is a view in section of the support arm in its stowed position, showing the panel lock mechanism.
Figure 10:
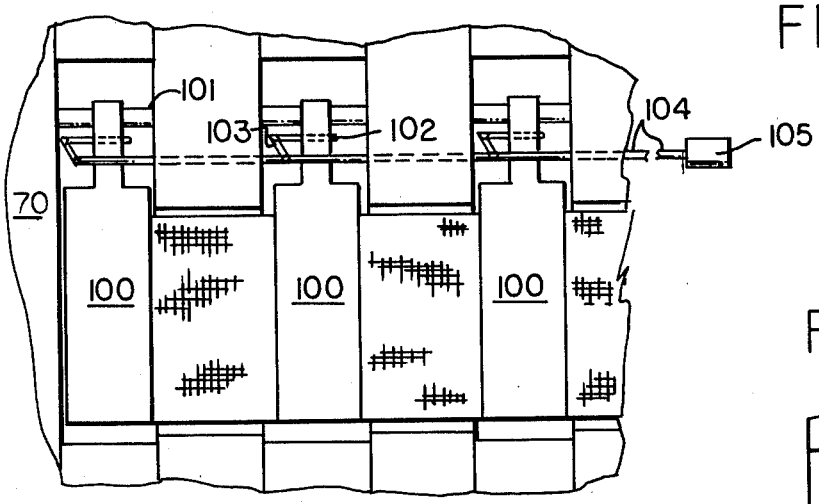
FIG. 10 is a view similar to FIG. 3 of a portion of a modified form of barge-supporting panel.
Figure 11:
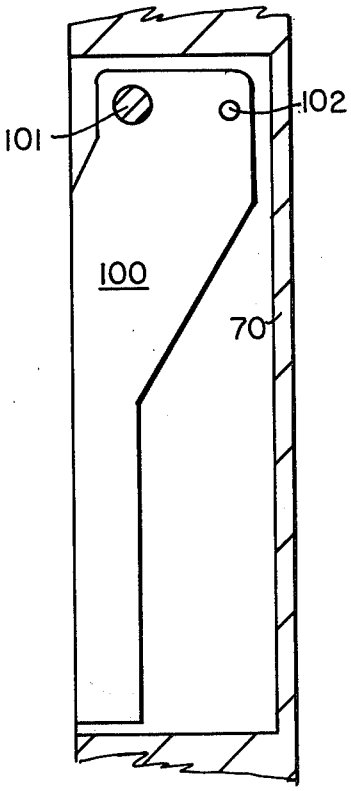
FIG. 11 is an enlarged view similar to FIG. 8 of a support arm for the panel of FIG. 10.
Figure 13:
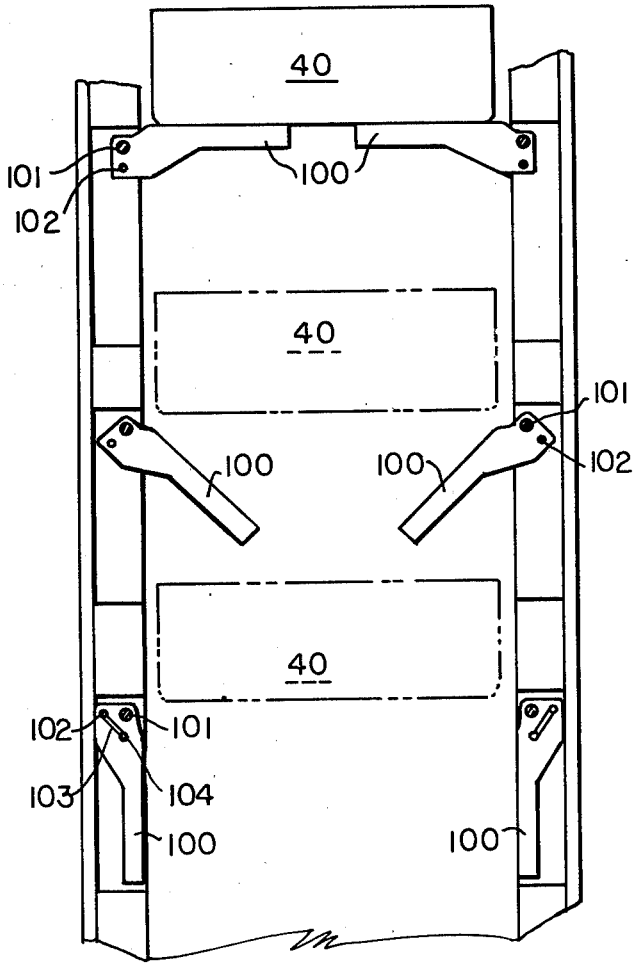
FIG. 13 is a view like FIG. 9 of the lock having the panels of FIG. 10.
Figure 12:
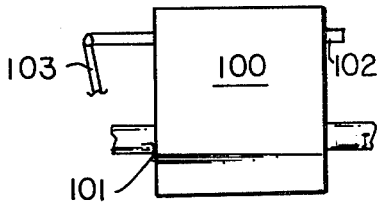
FIG. 12 is a fragmentary top plan view of one end of the support arm of FIG. 11.
Figures 14, 15, 16:
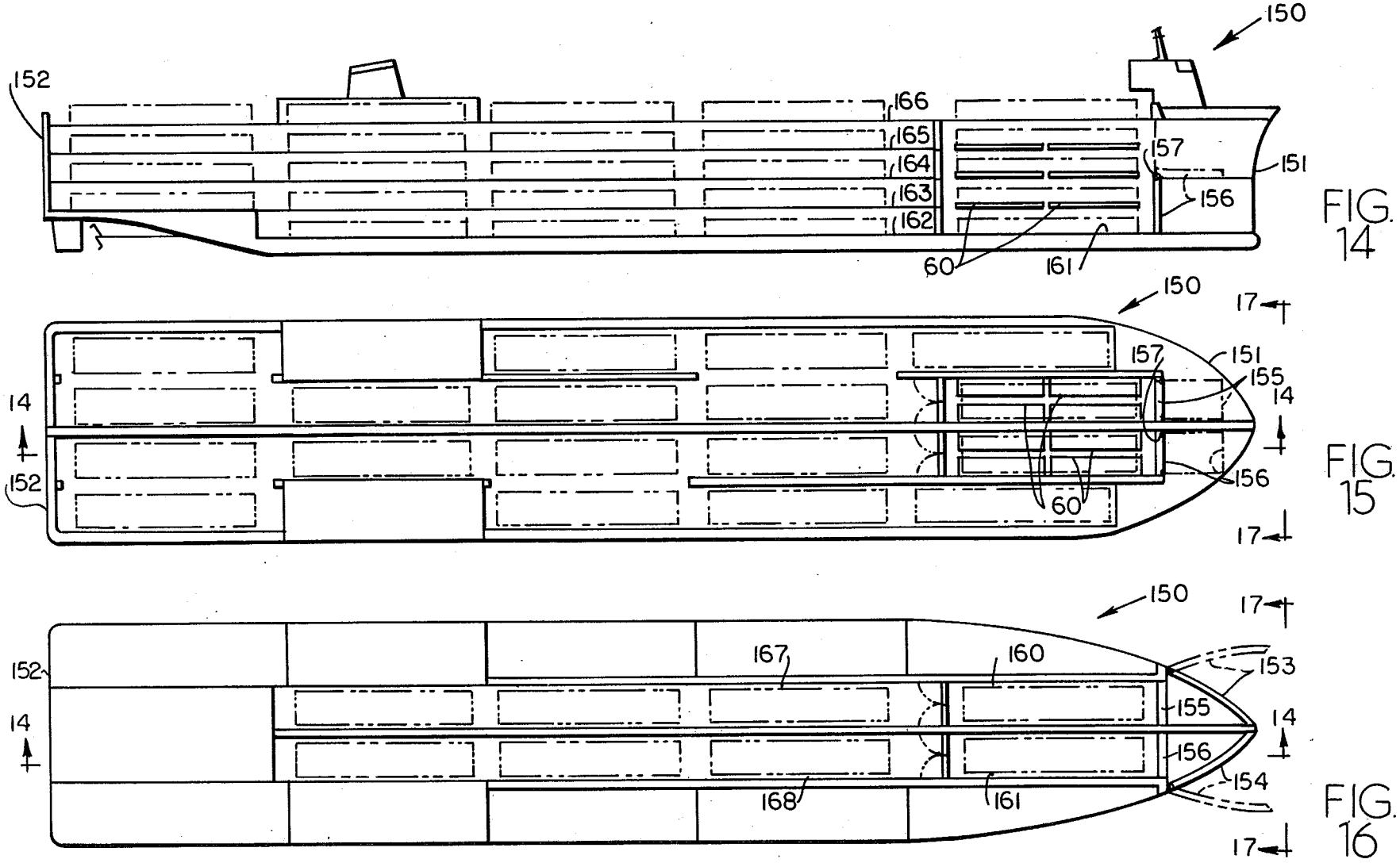
FIG. 14 is a view in side elevation and in section along the line 14—14 in FIG. 15 of a modified form of barge transporting vessel embodying the principles of the invention. The barge loading position of the collision bulkhead is shown in broken lines.
FIG. 15 is a top plan view of the vessel of FIG. 14.
FIG. 16 is a view in section taken along the line 16—16 in FIG. 14, with the open position of the bow gate shown in broken lines.

As shown in FIGS. 3 and 8, at each end of each panel 60 is a panel lock pin 90. A vertical rod 91 carries at its lower end a panel lock arm 92 having a notch 93 for engagement of the lock pin 90, thereby to lock the panel 60 in its vertical storage position during loading and unloading of the holds 35. When it is time to use the panels 60 for supporting a barge, the lock 46, 47, 48 or 49 is filled with water; the valves 80 and 81 prevent the entry of water into the buoyancy tanks 65 at this time. The light weight of the air-filled buoyancy tanks 65 also enables upward movement of the travel blocks 76 and 77 in their guideways 78.

Each arm 62 has, below its pivot opening 67 and offset therefrom a lock bar 95. For each lock bar 95 a lock stop 96 is recessed rigidly in the bulkhead 70. Both of these members 95 and 96 are preferably rectangular parallelepipeds. The springs 79 by their upward pull on the blocks 76 and 77 tend to raise the arms 62, and the buoyancy tanks 65, when filled with air, also tend to raise the arm 62. The resultant upward motion keeps the bar 95 above the stop 96 so that they do not engage each other during the upward swinging movement nor when the panel 60 finally reaches its horizontal position. However, when a barge 40 settles down from above on the panels 60, it opens the valves 80 and 81 to admit water (for eliminating its buoyancy when the arm 62 is being restored) and soon thereafter rests on the panels, so that whether the water drains out of the tanks 65 or not, the weight of the barge 40 pushes the arms 62 down vertically, carrying the blocks 76 and 77 down and urging the lock bar 95 into a position just in front of the lock stop 96, so that (being rectangular ) the bar 95 and stop 96 engage and prevent downward rotation of the arms 62 and of the panel 60. The panel 60 is thus locked in its load-supporting position so long as the barge 40 rests thereon.

When the ship is to be unloaded, the lock is filled with water to a level where the barge 40 is floated up above the panel 60. The buoyancy tanks 65, which have filled with water during the flooding of the lock cause their support arms 62 to swing down to a vertical position while the springs 79 simultaneously lift the blocks 76 and 77 so that the bar 95 is released from the stop 96. The arms 62, then, swing down to their vertical position when the water level in the lock is lowered, and the buoyancy tanks drain and become lighter, so that the side of the bar 95 comes to rest on the top side of the step 96. The lock pin 90 then is engaged in the notch 93 of the panel lock arm 92, by control from the vessel's main deck through actuation of the vertical rod 91.

Operation of the Device of FIG. 3–9

After the holds 35 are fully loaded, a stern gate 56, 57, 58 or 59 is opened, and a barge 40 is floated into the corresponding lock 46, 47, 48, or 49; the stern gate is then closed. The barge lock 46, 47, 48, or 49 is filled with water to a level greater than the draft of a barge 40 above the level of the uppermost, vertically stowed set 61 of four panels which is to support the barge 40.

Figure 9:
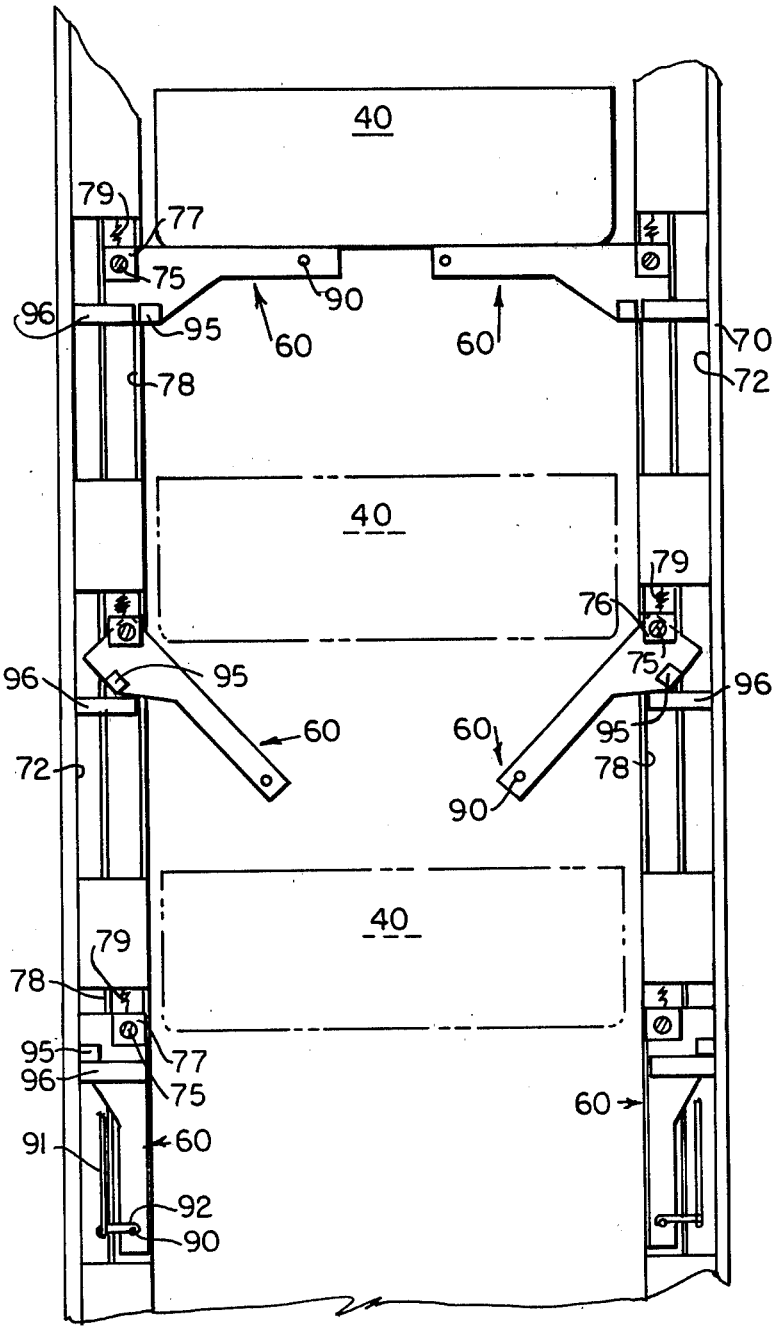
FIG. 9 is an end view partly in section of a lock chamber embodying the principles of the invention, with three sets of panels, the top one being fully erected and in its load-supporting position, the middle one shown while being swung up toward its horizontal position, and the bottom one in its storage position.

As the barge 40 rises in the lock 46, 47, 48, or 49 to a level above the stored panels 60, the control rods 91 are operated to free the panel lock pin 90 from their notches 93. The panels 60 float upwardly, as shown at the center of FIG. 9, swinging to their horizontal position, shown at the upper part of FIG. 9. The lock water level is then lowered, and the barge 40 settles onto the panels 60, depressing the contact platforms 85, so that the valve actuators 82 and 83 open the check-type flood valves 80 and 81 and admit water to the buoyancy tanks 65. As the weight of the barge 40 is transferred down on to the support arm 62, it moves the travel blocks 76 and 77 down, and the lock bar 95 is engaged and locked against the lock stop 96, and the barge 40 is now in place. Another barge 40 may now be loaded onto the next lowest set 61 of panels 60. This lock loading operation may take place one level at a time at each tier 44, 43, 42, from the top down, immediately after that tier of holds 35 has been loaded, or after all the holds 35 for the entire vessel have been loaded. The same is true for unloading but in reverse order of tiers.

To unload a barge 40 in this embodiment, the lock 46, 47, 48 or 49 is flooded to a level at least equal to the draft of a typical barge above the lowest set 61 of panels 60, causing the stowed barge 40 to float above that set 61 of panels 60. The buoyancy tanks 65 on this set 61 of support arms 62 are filled with water as the lock water level rises above them, since the valve actuators 82 and 83 are at that time depressed by the weight of the barge 40, leaving the check valves 80 and 81 open.

The water-weighted panels 60 swing them down toward and into the vertical stowed position, since the buoyancy tanks 65 are filled with water. The deck-controlled rods 91 may then be operated to actuate the locking mechanisms 90 and 93, but, preferably, this is actuated automatically, thereby securing the panels 60 in their vertical storage positions. As the lock water level is lowered with it and also the buoyancy tanks 65 will drain of water as air flows in through the vent valves 88, so that the arms 62 are ready to be floated up to their horizontal position again when needed. The appropriate stern gate 56, 57, 58, or 59 is opened and the barge 40 is floated out of its lock 46, 47, 48, or 49.

A Modified Form of the Support Arm Locking Mechanism CL (FIGS. 10–13)

In the embodiment of the invention illustrated in FIGS. 10–13 an end portion 100 of each support arm has a hinge pin recess 101, and each panel-supporting bulkhead projection has a lock pin 102 connected by a rod 103 to a gang link arm 104 disposed horizontally through the bulkhead 70. The gang link arm 104 is in turn connected to a remote-control hydraulic ram actuator 105. When the panels 60 are in the horizontal position, the hydraulic ram actuator 105 is engaged to move the gang link arm 104, in turn moving the lock pins 102 into the lock pin recesses 101 in each support arm, thereby locking each panel 60 in a load-supporting position for supporting a barge 40.

A Bow Opening Vessel (FIGS. 14–17)

A vessel 150 differs from the vessel 30 in that flotation loading of the vessel is done through its bow 151 rather than through its stern 152. This enables use of better hull lines at the stern and thereby improves operation and efficiency.

Bow gates 153 and 154 open outwardly to each side for loading and unloading of barges. As in our U.S. Pat. No. 4,135,468, the vessel 150 is provided with upwardly swinging collision bulkheads 155 and 156 that are pivoted along an axis 157. The two bow gates 153 and 154 and the corresponding collision bulkheads 155 and 156 open into a pair of loading locks 160 and 161, like the locks already described and provided with the same means for storing barges in the locks 160 and 161.

In the vessel 150 there are five tiers 162, 163, 164, 165 and 166 of holds for storing the barges. On the lowest tier 162, there are two holds 167 and 168. On each of the other four tiers 163, 164, 165, and 166 there are four holds per tier. Archways and passages enable transfer of barges from each inboard hold to an outboard hold as shown in our U.S. Pat. No. 4,147,123. The top tier 166 may be an open-topped deck. The vessel 150 can hold eighty of the large Mississippi River barges, including ten barges stored in the locks 160 and 161.

The preferred embodiment described herein is intended to be purely illustrative, and not limiting of the scope of the invention. Other embodiments and variations will be apparent to those skilled in the art and may be made without departing from the essence and scope of the invention as defined in the following claims.

We claim:

1. A load-supporting system for use in a sometimes flooded space defined by vertical walls and a bottom wall, comprising:
   - a plurality of parallel spaced-apart support arms, each having attachment means for pivotal attachment along a horizontal axis to a said vertical wall, and a load-support portion comprising a buoyancy tank, normally filled with air during storage and during upward swinging movement from a generally vertical storage position up to a generally horizontal load-supporting position,
   - first locking means for securing said arms in their storage position, from which they tend to swing up when released,
   - second locking means for securing said arms in their load-supporting position, from which they tend to swing down when released,
   - first lock release means for releasing said arms from said first locking means, and
   - second lock release means for releasing said arms from said second locking means.

2. A load-supporting system for use in a sometimes flooded space defined by a bottom wall and generally vertical walls comprising:
   - a plurality of parallel spaced-apart support arms, each having attachment means for pivotal attachment along a horizontal axis to a said vertical wall, and a load-support portion comprising a buoyancy tank, normally filled with air during storage and during upward swinging movement from a generally vertical storage position up to a generally horizontal load-supporting position,
   - valve means actuated by the weight of a load resting on said load support portion, for enabling said buoyancy tank, when below water level, to fill with water for assisting in downward swinging movement from its horizontal load-supporting position down to its storage position,
   - first locking means for securing said arms in their storage position, from which they tend to swing up because of their buoyancy when released,
   - second locking means for securing said arms in their load-supporting position, from which they tend to swing down, ballasted by water, when released,
   - first lock release means for releasing said arms from said first locking means, and
   - second lock release means for releasing said arms from said second locking means.

3. The load-supporting system of either claim 1 or claim 2 having connecting means for securing adjacent support arms together to swing in unison.

4. The load-supporting system of either claim 1 or claim 2 having a plurality of grating sections disposed between and secured to the buoyancy tanks of adjacent support arms and connecting them together on a level with the upper surface thereof, to swing in unison as a panel.

5. The load-supporting system of claim 4 wherein there are two said first locking means with respective said first lock release means, one of each of said first locking means being adjacent to each end of said panel.

6. A load-supporting system for use in a sometimes flooded space defined by a bottom wall and generally vertical walls comprising:
   - a plurality of parallel spaced-apart support arms, each having attachment means for pivotal attachment to a said vertical wall, and a load-support portion comprising a buoyancy tank, normally filled with air during storage and during upward swinging movement from a generally vertical storage position up to a generally horizontal load-supporting position, valve means actuated by the weight of a load resting on said load support portion, for enabling said buoyancy tank, when below water level, to fill with water for assisting in downward swinging movement from its horizontal load-supporting position down to its storage position, first locking means for securing said arms in their storage position, second locking means for securing said arms in their load-supporting position, first lock release means for releasing said arms from said first locking means, and second lock release means for releasing said arms from said second locking means, the valve means for each said buoyancy tank comprising:

check valve means on each said buoyancy tank for normally preventing flow of fluid into said buoyancy tank and permitting flow of liquid out from said buoyancy tank when said buoyancy tank is in a generally vertical position, valve actuator means on each said buoyancy tank for overriding said check valve means, said valve actuator means responding to the weight of a heavy load on said panel for opening said check valve means to enable fluid to flow into said buoyancy tank, so that it can fill with water when said space is flooded up to said load and can therefore sink of its own weight when said second lock release means is actuated.

7. The load-supporting system of claim 6 wherein said valve actuator means comprises:

a valve linkage inside said buoyancy tank connected to said check valve means, a spring-urged stem connected at one end to said valve linkage, a contact head connected to the other end of said spring-urged stem, said spring-urged stem normally holding said contact head up from the top of said tank, whereby depressing said head toward the top of said tank moves said spring-urged stem downward, thereby moving said valve linkage to open said check valve means.

8. The load-supporting system of claim 6 wherein said valve means comprises:

first and second valves spaced-apart from each other and at opposite ends of the upper surface of said buoyancy tank.

9. The load supporting system of claim 6 having venting means for venting said buoyancy tank to atmosphere while the said check valve means drains water from said buoyancy tank.

10. The load supporting system of claim 9 wherein said venting means comprises a vent opening at the inboard end of said buoyancy tank, said inboard end being the upper end when said tank is vertical, a vent closure member at said vent opening, a spring normally urging said vent closure member to close said vent opening, and a float valve responsive to the liquid level in said buoyancy tank and connected to said vent closure member by override means for opening said vent opening so long as there is a substantial amount of liquid in said tank.

11. A load-supporting system for use in a sometimes flooded space defined by a bottom wall and generally vertical walls comprising:

a plurality of parallel spaced-apart support arms, each having attachment means for pivotal attachment to a said vertical wall, and a load-support portion comprising a buoyancy tank, normally filled with air during storage and during upward swinging movement from a generally vertical storage position up to a generally horizontal load-supporting position, valve means actuated by the weight of a load resting on said load support portion, for enabling said buoyancy tank, when below water level, to fill with water for assisting in downward swinging movement from its horizontal load-supporting position down to its storage position.

first locking means for securing said arms in their storage position, second locking means for securing said arms in their load-supporting position, first lock release means for releasing said arms from said first locking means, and second lock release means for releasing said arms from said second locking means, said first locking means and said first lock-release means comprising:

a panel lock pin projecting from one side of some of said support arms, a vertical rod operable from above said sometimes flooded space and extending down parallel to and supported for vertical up-and-down movement by the vertical wall to which said arm is pivotally mounted, and a lock arm secured to the lower end of said rod and having a notch for engagement with said panel lock pin, said pin automatically moving into engagement with said notch when said arm is swung down into its vertical storage position, said rod, when lifted, releasing said lock pin for upward swinging movement of said arm.

12. A load-supporting system for use in a sometimes flooded space defined by a bottom wall and generally vertical walls comprising:

a plurality of parallel spaced-apart support arms, each having attachment means for pivotal attachment to a said vertical wall, and a load-support portion comprising a buoyancy tank, normally filled with air during storage and during upward swinging movement from a generally vertical storage position up to a generally horizontal load-supporting position, valve means actuated by the weight of a load resting on said load support portion, for enabling said buoyancy tank, when below water level, to fill with water for assisting in downward swinging movement from its horizontal load-supporting position down to its storage position, first locking means for securing said arms in their storage position, second locking means for securing said arms in their load-supporting position, first lock release means for releasing said arms from said first locking means, and second lock release means for releasing said arms from said second locking means, said second locking means and said second lock release means comprising:

a locking bar extending outward from one side of each said support arm near its inboard end, at a point below said pivotal attachment means, and a locking stop secured to a said wall adjacent to said locking bar in such a position that a vertical surface of said locking bar engages a vertical surface of said locking stop when said arm is in load-supporting position and is also supporting a heavy load, a pair of vertical guideways secured to said wall, one on each side of said support arm, a pair of pin travel blocks, each disposed in a said vertical guideway for free movement up and down therein, spring means normally urging each block upwardly, and a hinge pin of said pivotal attachment means extending through said support arm near its upper end and secured at each end to a said travel block, so that said spring means lift said travel blocks and said support arms when the heavy load no longer rests on said support arms and thereby disengages said locking bar from said locking stop, enabling said support arm when its buoyancy tank is filled with water to swing downwardly toward its vertical position.

13. A load-supporting system for use in a sometimes flooded space defined by a bottom wall and generally vertical walls comprising:

a plurality of parallel spaced-apart support arms, each having attachment means for pivotal attachment to a said vertical wall, and a load-support portion comprising a buoyancy tank, normally filled with air during storage and during upward swinging movement from a generally vertical storage position up to a generally horizontal load-supporting position, valve means actuated by the weight of a load resting on said load support portion, for enabling said buoyancy tank, when below water level, to fill with water for assisting in downward swinging movement from its horizontal load-supporting position down to its storage position, first locking means for securing said arms in their storage position, second locking means for securing said arms in their load-supporting position, first lock release means for releasing said arms from said first locking means, and second lock release means for releasing said arms from said second locking means, said second locking means and said second lock release means comprising:

lock pin receiving means in some of said support arms disposed below said pivotal attachment means, a lock pin for each said receiving means, and control means supporting said lock pin for engagement thereof in said receiving means and release therefrom.

14. An improvement in a barge-carrying flotation-loaded waterborne vessel having:

a hollow interior defining upper and lower longitudinal barge holes arranged in vertical rows of aligned tiers, each hold being flooded while it is loaded and while it is unloaded, at least one loading lock at one end of the vessel for enabling flotation loading of each of said vertical rows of barge holds, each lock having a pair of side bulkheads and a bottom, each lock also having its own separate gate means for separating said lock from and opening it to the outside for flotation loading and unloading of one barge at a time, a separate lock gate for each tier of each row for connecting to a hold of each said row to a lock, the improvement comprising:

a set of barge support panels, each pivotally attached by a horiziontal longitudinally extending pivot to one of said side bulkheads, one said set disposed on each side of said lock adjacent to and approximately on a level with each upper longitudinal barge hold, erection means associated with each said set of barge support panels for moving said panels upward from a vertical storage position to a horizontal barge-supporting position, first locking and releasing means for securing each said panel in its vertical storage position and for releasing each said panel for movement to its load-supporting position, and second locking and releasing means for securing each said panel in its horizontal barge-supporting position and for releasing each said panel to return to its vertical storage position.

15. An improvement in a barge-carrying flotation-loaded waterborne vessel having:

a hollow interior defining upper and lower longitudinal barge holds with vertical walls, said holds arranged in vertical rows of aligned tiers, each hold being flooded while it is loaded and while it is unloaded, at least one loading lock at one end of the vessel for enabling flotation loading of each of said vertical rows of barge holds, each lock having a pair of side bulkheads and a bottom, each lock also having its own separate gate means for separating said lock from and opening it to the outside for flotation loading and unloading of one barge at a time, a separate lock gate for each tier of each row for connecting a hold of each said row to a lock, the improvement comprising:

a set of barge support panels, each pivotally attached by a horizontal longitudinally extending pivot to one of said side bulkheads, one said set disposed on each side of said lock adjacent to and approximately on a level with each upper longitudinal barge hold, erection means associated with each said set of barge support panels for moving said panels upward from a vertical storage position to a horizontal barge-supporting position, first locking and releasing means for securing each said panel in its vertical storage position and for releasing each said panel for movement to its load-supporting position, and second locking and releasing means for securing each said panel in its horizontal barge-supporting position and for releasing each said panel to return to its vertical storage position, each said barge-support panel comprising:

a plurality of parallel spaced-apart support arms, each having attachment means for pivotal attachment to a said bulkhead, and a load support portion comprising a normally-air-filled buoyancy tank; and connecting means for securing the adjacent support arms of a panel together to swing in unison.

16. The device of claim 15 wherein there is a separate loading lock for each vertical row of holds and a separate lock gate for connecting each hold directly to a said lock.

17. The device of claim 15 wherein there are fewer loading locks than rows of holds and transfer means for passage on each tier that has more rows than locks for transferring barges by flotation from one hold that is connected directly to a said lock to a hold that is not so connected.

18. The device of claim 15 wherein said locks are at the stern end of the vessel.

19. The device of claim 15 wherein having a pair of said locks located at the bow end of said vessel, said bow end having a vertically pivoted outwardly swinging gate on each side thereof and a horizontally pivoted upwardly swinging collision bulkhead between each said gate and a corresponding said lock.

20. An improvement in a barge-carrying flotation-loaded waterborne vessel having:

a hollow interior defining a series of upper and lower longitudinal barge holds with vertical walls, said holds arranged in a series of vertical rows of aligned tiers, each hold being flooded while it is loaded and while it is unloaded, at least one loading lock at one end of the vessel enabling flotation loading of each of said vertical row of barge holds, each lock having a pair of side bulkheads and a bottom, each lock also having its own separate gate means for separating said lock from and opening it to the outside for flotation loading and unloading of one barge at a time, a separate lock gate for each tier of each row for connecting a hold of each said row to a lock, the improvement comprising:

a set of barge support panels disposed on both sides of said lock adjacent to and approximately on a level with each longitudinal barge hold, except the lowest one, each said panel comprising a plurality of parallel spaced-apart support arms, each arm having attachment means for pivotally mounting it to a said bulkhead, and a load support portion comprising an air-filled buoyancy tank, connecting means for securing the adjacent support arms of a panel together to swing in unison, first locking and releasing means for securing each said panel in its vertical storage position and for releasing each said panel for movement to its load-supporting position, second locking and releasing means for securing each said panel in its horizontal barge-supporting position and for releasing each said panel to return to its vertical storage position, each said buoyancy tank being normally filled with air during storage and during upward swinging movement from a generally vertical storage position to a generally horizontal load-supporting position, check valve means for enabling exit of liquid from said buoyancy tank when said tank is in a generally vertical position, while preventing passage of liquid thereinto, and load-actuated overriding valve opening means, actuated by the weight of a barge supported on said panels, for opening said check valve means to enable the passage of liquid into said buoyancy tank.

21. The vessel of claim 20 wherein said valve opening means comprises:

a valve linkage inside said buoyancy tank connected to said check valve means, a spring-urged stem connected at one end to said valve linkage, a contact head connected to the other end of said spring-urged stem, said spring-urged stem normally holding said contact head up from the top of said tank, whereby depressing said head toward the top of said tank moves said spring-urged stem downward, thereby moving said valve linkage to open said check valve means.

22. The vessel of claim 21 wherein said valve means comprises:

first and second valve spaced-apart from each other and at opposite ends of the upper surface of said buoyancy tank.

23. The load supporting system of claim 20 having venting means for venting said buoyancy tank to atmosphere while the said check valve means drains water from said buoyancy tank.

24. The load supporting system of claim 23 wherein said venting means comprises a vent opening at the inboard end of said buoyancy tank, said inboard end being the upper end when said tank is vertical, a vent closure member at said vent opening, a spring normally urging said vent closure member to close said vent opening, and a float valve responsive to the liquid level in said buoyancy tank and connected to said vent closure member by override means for opening said vent opening so long as there is a substantial amount of liquid in said tank.

25. The vessel of either of claims 15 or 20 wherein said first locking and release means comprises, a panel lock pin projecting from one side of some of said support arms, a vertical rod operable from above the portion of the hold which is floaded during loading and extending down parallel to and supported for vertical up-and-down movement by the vertical wall to which said arm is pivotally mounted, and a lock arm secured to the lower end of said rod and having a notch for engagement with said panel lock pin, said pin automatically moving into engagement with said notch when said arm is swung down into its vertical storage position, said rod, when lifted, releasing said lock pin for upward swinging movement of said arm.

26. The vessel of either of claim 15 or 20 wherein:

said second locking and release means comprises, a locking bar extending outward from one side of each said support arm near its inboard end, at a point below said pivotal attachment means, and a locking stop secured to a said wall adjacent to said locking bar in such a position that a vertical surface of said locking bar engages a vertical surface of said locking stop when said arm is in load-supporting position and is also supporting a heavy load, a pair of vertical guideways secured to said wall, one on each side of said support arm, a pair of pin travel blocks, each disposed in a said vertical guideway for free movement up and down therein, spring means normally urging each block upwardly, and a hinge pin of said pivotal attachment means extending through said support arm near its upper end and secured at each end to a said travel block, so that said spring means lift said travel blocks and said support arm when the heavy load no longer rests on said support arm and thereby disengages said locking bar from said locking stop, enabling said support arm when its buoyancy tank is filled with water to swing downwardly toward its vertical position.

27. The vessel of either of claims 15 or 20 wherein said second locking and releasing means comprises, lock pin receiving means in some of said support arms disposed below said pivotal attachment means, a lock pin for each said receiving means, and control means supporting said lock pin for engagement thereof in receiving means and release therefrom.

28. The vessel of either of claims 15 or claim 20 wherein said connecting means comprises a plurality of grating sections disposed between and secured to the buoyancy tanks of adjacent support arms and connecting them together on a level with the upper surface thereof, to swing in unison, and said bulkheads comprise corrugated vertical walls with recesses to receive said arms for vertical storage while said grating sections simultaneously rest adjacent the outer parts of said corrugations.

* * * * *